US008529220B2

(12) United States Patent
Suzuki et al.

(10) Patent No.: US 8,529,220 B2
(45) Date of Patent: Sep. 10, 2013

(54) HIGH-PRESSURE PUMP

(75) Inventors: Yoshihito Suzuki, Obu (JP); Masahiro Fukui, Kariya (JP); Shinobu Oikawa, Kariya (JP)

(73) Assignee: Denso Corporation, Kariya (JP)

( * ) Notice: Subject to any disclaimer, the term of this patent is extended or adjusted under 35 U.S.C. 154(b) by 243 days.

(21) Appl. No.: 13/008,200

(22) Filed: Jan. 18, 2011

(65) Prior Publication Data

US 2011/0176944 A1 Jul. 21, 2011

(30) Foreign Application Priority Data

Jan. 18, 2010 (JP) ..... 2010-7899
Jun. 29, 2010 (JP) ..... 2010-147696

(51) Int. Cl.
*F04B 49/00* (2006.01)

(52) U.S. Cl.
USPC ..... 417/307; 417/505; 411/519

(58) Field of Classification Search
USPC ..... 417/307, 505; 411/519
See application file for complete search history.

(56) References Cited

U.S. PATENT DOCUMENTS

| | | | | |
|---|---|---|---|---|
| 5,582,153 | A * | 12/1996 | Dutt et al. | 123/450 |
| 6,254,103 | B1 | 7/2001 | Cooke | |
| 7,114,928 | B2 | 10/2006 | Asayama et al. | |
| 2003/0161746 | A1 | 8/2003 | Asayama et al. | |
| 2009/0097997 | A1 * | 4/2009 | Suzuki et al. | 417/470 |
| 2009/0311118 | A1 * | 12/2009 | Inoue et al. | 417/572 |

FOREIGN PATENT DOCUMENTS

| | | |
|---|---|---|
| EP | 1 413 756 | 4/2004 |
| JP | 3-203711 | 9/1991 |
| JP | 9-137820 | 5/1997 |
| JP | P2000-97343 A | 4/2000 |
| JP | P2001-295770 A | 10/2001 |
| JP | 2003-113759 | 4/2003 |
| JP | P2005-344685 A | 12/2005 |

* cited by examiner

*Primary Examiner* — Charles Freay
*Assistant Examiner* — Patrick Hamo
(74) *Attorney, Agent, or Firm* — Nixon & Vanderhye P.C.

(57) ABSTRACT

A housing of a high-pressure pump defines a passage communicating with a pressurizing chamber in which fuel is pressurized. The passage has an annular engagement groove which is radially outwardly concaved on its inner wall surface. A valve body is disposed in the passage. The engaged member is disposed inside of the passage wall. A valve body engaging member is comprised of a plurality of arc-shaped plate members, which form circular shape. The valve body engaging member is inserted into the engagement groove in such a manner as to be engaged with the valve body. A C-ring is firmly in contact with the plate members and biases them toward the engagement groove.

9 Claims, 10 Drawing Sheets

HIGH-PRESSURE PUMP

CROSS-REFERENCE TO RELATED APPLICATION

This application is based on Japanese Patent Applications No. 2010-7899 filed on Jan. 18, 2010, and No. 2010-147696 filed on Jun. 29, 2010, the disclosures of which are incorporated herein by reference.

FIELD OF THE INVENTION

The present invention relates to a high-pressure pump which pressurizes fuel by a plunger.

BACKGROUND OF THE INVENTION

A high-pressure pump has a plunger which reciprocates to pressurize fuel in a pressurizing chamber. JP-2003-113759A shows a high-pressure pump which has a valve body and a suction valve. The valve body and the suction valve are arranged in a fuel passage communicating with a pressurizing chamber. The suction valve is seated on or unseated from a valve seat provided to the valve body in order to adjust a fuel quantity introduced into the pressurizing chamber.

In this high-pressure pump, a fastening member is threaded into a housing and its axial fastening force is applied to the valve body through an engaging member so that the valve body is fixed in the housing. The axial fastening force of the fastening member is set a large value in order to avoid a loose of the fastening member. Thus, the engaging member between the fastening member and the valve body should have a mechanical strength against the axial fastening force. The engaging member has thickness enough to endure the axial fastening force.

Consequently, the size and weight of the high-pressure pump are increased and a manufacturing cost is also increased.

EP-1413756A1 shows a high-pressure pump which has an annular engagement groove on a fuel passage inner wall surface. An engaging member having C-shape is engaged with the annular engagement groove. The engaging member is also engaged with the valve body to prevent the valve body from moving opposite to the pressurizing chamber. The engaging member receives large pressure from the fuel in the pressurizing chamber at a surface contacting with the valve body. In order to reduce stress applied to the engaging member, the annular engagement groove should have great depth. When the C-shaped engaging member is brought into an engagement with the engagement groove, the engaging member should be deformed in such a manner that an outer diameter of the engaging member becomes smaller than an inner diameter of the annular engagement groove. If the engaging member is made from general material, it is likely that the engaging member is plastically deformed to loose a spring function. On the other hand, if the engaging member is made from material of which hardness is improved by heat-treating, it becomes difficult to deform the engaging member so as to engage the engaging member with the engagement groove.

SUMMARY OF THE INVENTION

The present invention is made in view of the above matters, and it is an object of the present invention to provide a high-pressure pump which is easily assembled and has high durability.

The high-pressure pump is provided with a plunger, a housing, an engaged member, an engaging member, and a resilient member. The housing has a pressurizing chamber where a fuel is pressurized by the plunger, a fuel passage which communicates with the pressurizing chamber, and an annular engagement groove which is formed on a passage wall defining the fuel passage. The engaged member is disposed inside of the passage wall. The engaging member is comprised of a plurality of arc-shaped plate members, which form circular shape. The engaging member is inserted into an engagement groove formed in the housing in such a manner as to be in contact with the engaged member. The resilient member is disposed inside of the engaging member in such a manner as to resiliently bias the arc-shaped plate members radially outwardly. Thereby, it is restricted that the engaging member is disengaged from the engagement groove.

When assembling the engaging member to the housing, a plurality of arc-shaped plate members are inserted into the engagement groove. Then, the resilient member is assembled inside of the engaging member. Since the engaging member is comprised of a plurality of arc-shaped plate members, it is unnecessary to elastically inwardly deform the engaging member when assembling the engaging member to the engagement groove. Thus, the plate members can be made of material having high hardness. Alternatively, the plate members can receive heat treating to improve the hardness thereof. The mechanical strength of the engaging member can be improved without deteriorating its assembling work.

Furthermore, according to the present embodiment, the engaged member can be positioned by the engaging member without utilizing an axial fastening force of a fastening member such as a bolt. Thus, it is unnecessary to configure the engaging member in such a manner as to receive the axial fastening force. The size of the high-pressure pump can be made smaller with low manufacturing cost.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
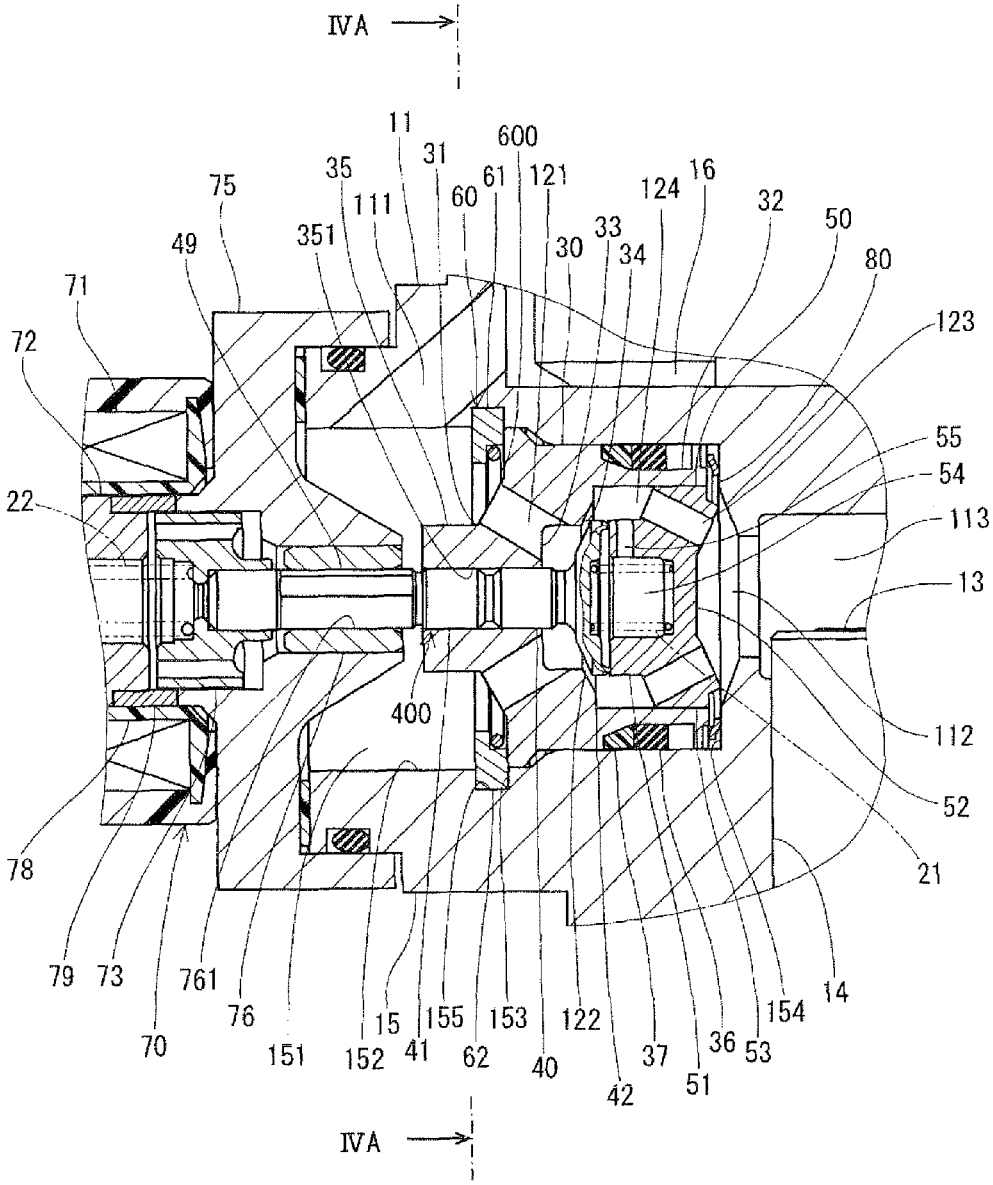
FIG. 1 is a fragmentary sectional view showing a high-pressure pump according to a first embodiment of the present invention.

Multiple embodiments of the present invention will be described with reference to accompanying drawings. In each embodiment, the substantially same parts and the components are indicated with the same reference numeral and the same description will not be reiterated.

First Embodiment

FIGS. 1 to 6 show a high-pressure pump according to a first embodiment. A high-pressure pump 10 is a fuel pump which supplies fuel to an injector of a diesel engine or a gasoline engine.

Figure 2:
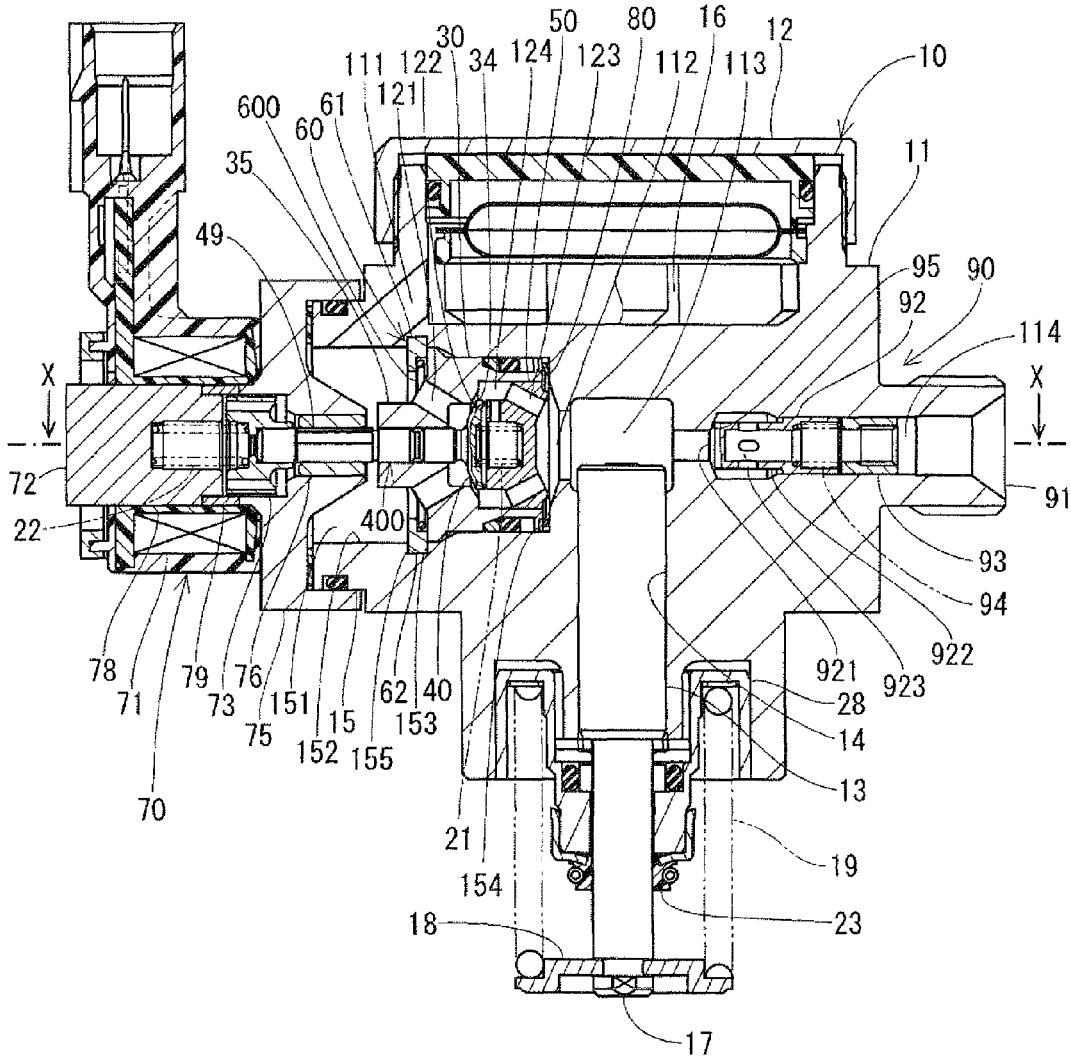
FIG. 2 is a sectional view showing a high-pressure pump according to the first embodiment.

As shown in FIG. 2, the high pressure pump 10 is provided with a housing body 11, a cover 12, a plunger 13, a valve body 30, a valve member 400, a spring 21, a spring 22, an electromagnetic driving portion 70, a valve body engaging member 60, and a C-ring 600. The housing body 11 is made of martensite stainless steel and defines a cylinder 14 therein. The cylinder 14 receives a plunger 13 reciprocatably.

The housing body 11 defines an introduce passage 111, a suction passage 112, a pressurizing chamber 113, and a discharge passage 114. The housing body 11 has a cylinder portion 15. The cylinder portion 15 defines a passage 151 fluidly connecting the introducing passage 111 and the suction passage 112. This passage 151 corresponds to a part of a fuel passage of the present invention. The passage 151 is defined by a cylindrical passage wall surface 152 of the cylinder portion 15. The cylinder portion 15 has an annular engagement groove 153 which is radially outwardly concaved on the passage wall surface 152. An annular wall surface 154 is formed between the engagement groove 153 and the pressurizing chamber 113. The valve body 30 is provided inside of the passage wall surface 152 between the engagement groove 153 and the annular wall surface 154.

A fuel chamber 16 is formed between the housing body 11 and the cover 12. The housing body 11 has a fuel inlet (not shown) communicating with the fuel chamber 16. A low-pressure pump (not shown) pumps up the fuel from a fuel tank and supplies the fuel to the fuel chamber 16. An introducing passage 111 communicates with the passage 151. One end of the suction passage 112 communicates with the pressurizing chamber 113. The other end of the suction passage 112 communicates with an interior of the annular wall surface 154. The introducing passage 111 and the suction passage 112 communicate with each other through the valve body 30 as shown in FIG. 1. The pressurizing chamber 113 communicates with the discharge passage 114.

The plunger 13 is accommodated in the cylinder 14 in such a manner as to reciprocate in its axial direction. A head 17 of the plunger 13 is engaged with a spring seat 18. A spring 19 is provided between the spring seat 18 and an oil-seal holder 28. The spring seat 18 is biased toward a cam (not shown) by the spring 19. The plunger 13 is reciprocated by being contacted with the cam through a tappet.

One end of the spring 19 is engaged with the oil-seal holder 28 and the other end is engaged with the spring seat 18. The spring 19 biases the tappet toward the cam through the spring seat 18. A space between the plunger 13 and the oil-seal holder 28 is fluidly sealed by the oil seal 23. The oil seal 23 prevents an engine-oil leakage from and into the pressurizing chamber 113.

A discharge valve portion 90 having a fuel outlet 91 is provided to the housing body 11. The discharge passage 114 communicates the pressurizing chamber 113 and the fuel outlet 91. A discharge valve seat 95 is formed at inner wall of the housing body 11.

The discharge valve portion 90 controls a discharge of fuel pressurized in the pressurizing chamber 113. The discharge valve portion 90 is comprised of a discharge valve 92, a regulation member 93, and a spring 94. The discharge valve 92 is made of martensite stainless steel of which hardness is improved by heat treating. The discharge valve 92 has a bottom portion 921 and a cylindrical portion 922. The discharge valve 92 is slidably disposed in the discharge passage 114. The regulation member 93 is arranged adjacent to the discharge valve 92. The regulation member 93 is made of austenite stainless steel. The hardness of the regulation member 93 is lower than that of the discharge valve 92. The regulation member 93 is press-fixed in the discharge passage 114. One end of the spring 94 is engaged with the regulation member 93 and the other end is engaged with the cylindrical portion 922. The discharge valve 92 is biased toward a discharge valve seat 95 by the spring 94. When the discharge valve 92 seats on the discharge valve seat 95, the discharge passage 114 is closed. When the discharge valve 92 moves away from the discharge valve seat 95, the discharge passage 114 is opened. The regulation member 93 functions as a stopper of the discharge valve 92.

When the fuel pressure in the pressurizing chamber 113 is increased, the fuel pressure which the discharge valve 92 receives is also increased. When fuel pressure in the pressurizing chamber 113 exceeds a specified value, the discharge valve 92 moves away from the discharge valve seat 95 against the biasing force of the spring 94. The fuel in the pressurizing chamber 113 is discharged outside of the high-pressure pump 10 from the fuel outlet 91 through the discharge passage 114, apertures 923 and the cylindrical portion 922.

When the fuel pressure in the pressurizing chamber 113 is decreased, the fuel pressure which the discharge valve 92 receives is also decreased. When fuel pressure in the pressurizing chamber 113 becomes lower than the specified value, the discharge valve 92 sits on the discharge valve seat 95. Thereby, it is prevented that the fuel in a delivery pipe (not shown) flows into the pressurizing chamber 113 through the discharge passage 114.

The valve body 30 is made of martensite stainless steel. The valve body 30, as shown in FIG. 1, is arranged inside of the passage wall surface 152 between the engagement groove 153 and the annular wall surface 154. The valve body 30 is engaged with the passage wall surface 152 by means of a valve body engaging member 60 and a plate spring 80. The C-ring 600 is made of austenite stainless steel and is engaged with an inner surface of the valve body engaging member 60. The C-ring 600 has resilience in its radial outward direction.

The C-ring 600 biases the valve body engaging member 60 radially outwardly so that it is prevented that the valve body engaging member 60 is disengaged from the engaging groove 153. The valve body 30 corresponds to "an engaged member", and the valve body engaging member 60 corresponds to "an engaging member" of the present invention.

The valve body 30 has a bottom portion 31 and a cylindrical portion 32. The valve body 30 has a concaved portion 33. A suction valve seat 34 is formed on an outer fringe of the concaved portion 33. The suction valve seat 34 is tapered with respect to an axial line of the valve body 30.

The valve body 30 has a first guide portion 35 at its bottom portion 31. The valve body 30 has a first inserting hole 351. Further, the valve body has a first passage 121. A plurality of the first passages 121 are arranged circumferentially with respect to an axial line of the valve body 30.

A seal member 36 and a backup ring 37 are provided between the cylindrical portion 32 and the passage wall surface 152. The seal member 36 prevents a fuel leakage between the pressurizing chamber 113 and the introducing passage 111.

A valve member 400 includes a suction valve 40 and a needle 49. The valve member 400 is made of martensite stainless steel. In the present embodiment, the suction valve 40 and the needle 49 are formed from separate pieces. The suction valve 40 is comprised of a shaft portion 41 and a disc portion 42. The shaft portion 41 is inserted into the first inserting hole 351 in such a manner that the suction valve 40 reciprocates in the valve body 30. The disc portion 42 is formed so as to sit on the suction valve seat 34. The suction valve 40 reciprocates so that the disc portion 42 sits on the suction valve seat 34 to close the passage 151 or moves away from the suction valve seat 34 to open the passage 151. Further, when the disc portion 42 moves away from the suction valve seat 34, a second passage 122 is defined between the suction valve 40 and the suction valve seat 34.

An inner diameter of the first inserting hole is substantially equal to or slightly larger than an outer diameter of the shaft portion 41. Thereby, the suction valve 40 reciprocates in the valve body 30 while the outer surface of the shaft portion 41 is slidably in contact with an inner wall surface of the first guide portion 35.

A stopper 50 is provided adjacent to the suction valve 40. The stopper 50 is comprised of a cylindrical portion 51, a bottom portion 52, and an enlarged portion 53. The enlarged portion 53 is welded to an inner wall surface of the cylindrical portion 32 of the valve body 30.

A spring 21 is provided between the stopper 50 and the suction valve 40. One end of the spring 21 is engaged with the bottom portion 52 and the other end is engaged with the suction valve 40. The spring 21 biased the suction valve 40 in its closing direction.

When the suction valve 40 is brought into a contact with the stopper 50, a volume chamber 54 is defined by the cylindrical portion 51 and the bottom portion 52 of the suction valve 40. The stopper 50 restricts a movement of the suction valve 40 in its opening direction. When the suction valve 40 is in contact with the cylindrical portion 51 of the stopper 50, the stopper 50 covers a part of the suction valve 40. Thereby, it is restricted that the fuel flowing to the suction valve 40 collides with the suction valve 40.

The enlarged portion 53 of the stopper 50 is provided with a plurality of third passages 123. Each of the third passages is arranged in a circumferential direction with respect to an axial line of the stopper 50. An intermediate passage 124 is defined between the second passage 122 and the third passage 123. The cylindrical portion 51 of the stopper 50 includes a communication passage 55 which connects the volume chamber 54 and the intermediate passage 124.

The first passage 121, the second passage 122, the third passage 123, and the intermediate passages 124 are included in the passage 151 formed in the housing body 11. That is, the fuel flows from the fuel chamber 16 to the pressurizing chamber 113 through the first passage 121, the second passage 122, the intermediate passage 124, and the third passage 123 in this series. Alternatively, the fuel flows from the pressurizing chamber 113 to the fuel chamber 16 through the third passage 123, the intermediate passage 124, the second passage 122, and the first passage 121 in this series.

As shown in FIG. 2, the electromagnetic driving portion 70 is comprised of a coil 71, a fixed core 72, a movable core 73, and a flange 75. The coil 71 is winded around a spool 78. When energized, the coil 71 generates a magnetic field. The fixed core 72 is made from magnetic material and is accommodated inside of the coil 71. The movable core 73 is made from magnetic material and confronts to the fixed core 72. The movable core 73 is slidably arranged in a cylindrical member 79 and the flange 75. The cylindrical member 79 is made from nonmagnetic material and prevents a magnetic short circuit between the fixed core 72 and the flange 75.

The flange 75 is made of magnetic material. As shown in FIG. 1, the flange 75 is fixed to the cylindrical portion 15 of the housing body 11, so that the electromagnetic driving portion 70 is held in the housing body 11. The flange 75 is provided with a second guide portion 76. The second guide portion 76 defines a second inserting hole 761.

The needle 49 is slidably inserted in the second inserting hole 761. An inner diameter of the second inserting hole is substantially equal to or slightly larger than an outer diameter of the needle 49. Thereby, the needle 49 reciprocates while its outer surface is slidably in contact with an inner wall surface of the second guide portion 76.

The needle 49 is welded to the movable core 73. The needle 49 can be in contact with the suction valve 40. The needle 49 reciprocates along with the suction valve 40.

A spring 22 is provided between the fixed core 72 and the movable core 73. This spring 22 biases the movable core 73 toward the suction valve 40. A biasing force of the spring 22 is greater than that of the spring 21. That is, the spring 22 biases the movable core 73 and the needle 49 toward the suction valve 40 against a biasing force of the spring 21. When the coil 71 is deenergized, the movable core 73 and the fixed core 72 are apart from each other. Therefore, while the coil 71 is not energized, the needle 49 is biased toward the suction valve 40 by the spring 22, and the suction valve 40 is apart from the suction valve seat 34. The coil 71, the fixed core 72, the movable core 73, the flange 75, the spool 78 and the cylindrical member 79 correspond to "a coil portion" of the present invention.

Referring to FIGS. 3A to 4B, the valve body engaging member 60 and the engagement groove 153 will be described in detail.

Figure 3A:
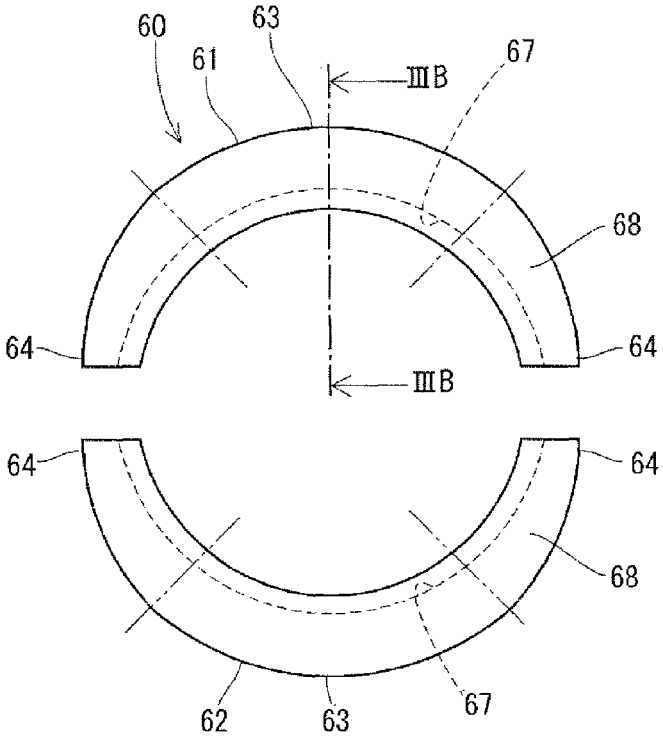
FIG. 3A is a front elevation view showing an engaging member which is comprised of two plate members.

As shown in FIG. 3A, the valve body engaging member 60 is comprised of two plate members 61, 62. These plate members 61, 62 are made of martensite stainless steel, and have substantially the same hardness of the valve body 30. The hardness of the plate members 61, 62 is greater than that of the C-ring 600. The first plate member 61 and the second plate member 62 are arc-shaped. As shown in FIG. 3C, in a case that the first plate member 61 are confronted to the second plate member 62, these plate members 61, 62 form an annular shape. In this situation, the valve body engaging member 60 has a first curved portion 63 and a second curved portion 64 of which curvature is different from each other. The first curved portion 63 and the second curved portion 64 are alternately formed in circumferential direction at intervals of 90°.

A curvature radius "Ra" of the first curved portion 63 is equal to a radius of a virtual circle "C1" illustrated by an alternate long and short dash line. The virtual circle "C1" has a center point indicated by a white circle. A curvature radius "Rb" of the second curved portion 64 is equal to a radius of a virtual circle "C2" illustrated by a two-dot chain line. The virtual circle "C2" has a center point indicated by a black circle. In the present embodiment, the curvature radius "Ra" is greater than the curvature radius "Rb" (Rb<Ra).

Figure 3B:
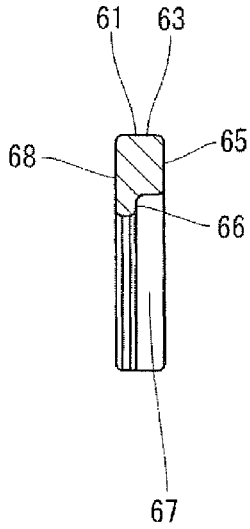
FIG. 3B is a cross sectional view taken along a line IIIB-IIIB of FIG. 3A.
Figure 3C:
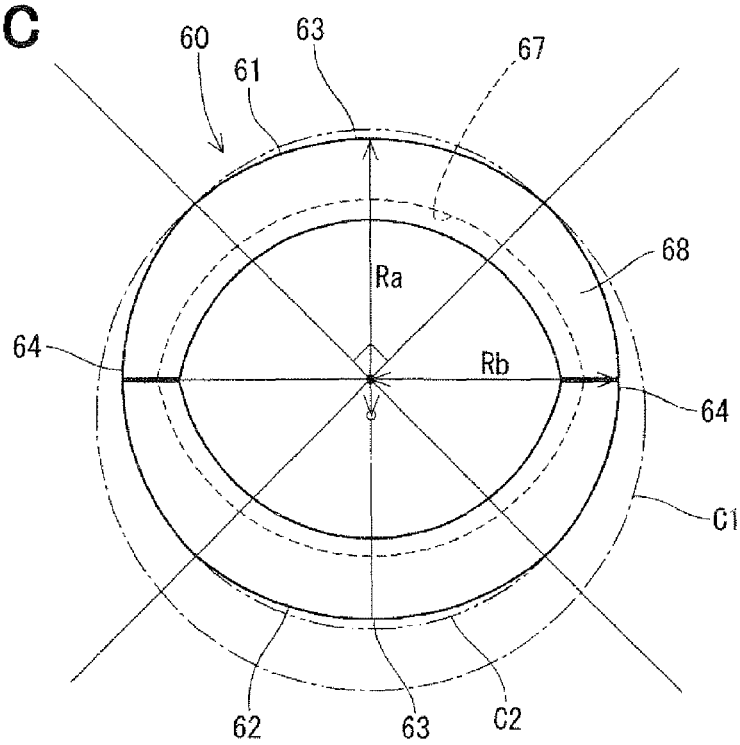
FIG. 3C is a front elevation view showing the engaging member in which two plates members are confronting to each other.

FIG. 3B is a cross sectional view taken along a line IIIB-IIIB in FIG. 3A. The first and second plate members 61, 62 have a step surface 66 at its contacting surface 65 which is in contact with the valve body 30. This step surface 66 defines a cylindrical step side wall 67.

Figure 4A:
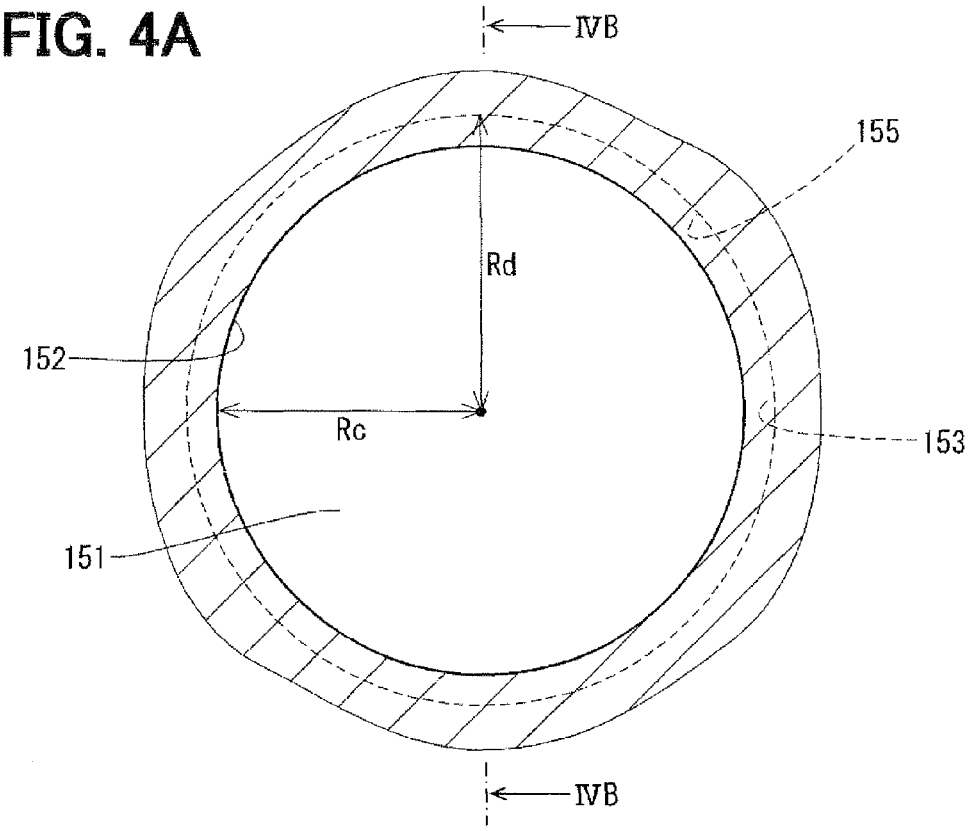
FIG. 4A is a cross sectional view taken along a line IVA-IVA of FIG. 1.
Figure 4B:
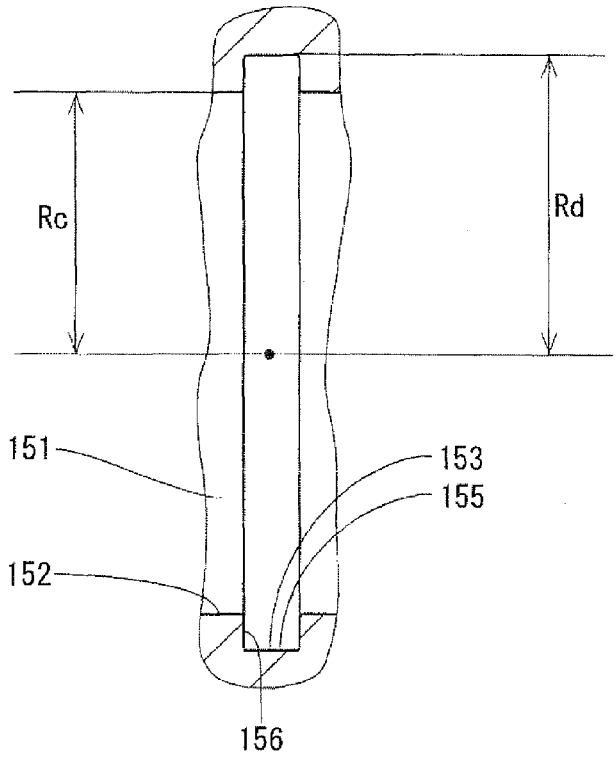
FIG. 4B is a cross sectional view taken along a line IVB-IVB of FIG. 4A.

As shown in FIGS. 4A and 4B, the engagement groove 153 is concaved radially outwardly on the passage wall surface 152 and is formed annularly along the passage wall surface 152. In a case where an inner diameter of the engagement groove 153 is denoted by "Rc" and an outer diameter of the engagement groove 153 is denoted by "Rd", a following relationship can be established.

$$Rb<Rc<Ra\leqq Rd \quad (1)$$

Referring to FIGS. 1 and 5, an assembling way of the valve body 30, the valve body engaging member 60, the C-ring 600 and the plate spring 80 to the housing body 11 will be described.

(1) The plate spring 80 is arranged in such a manner as to be in contact with the annular wall surface 154 of the housing body 11 (refer to FIG. 1).

(2) An assembly unit of the valve body 30, the suction valve 40, the stopper 50, the spring 21, the seal member 36 and the backup ring 37 is inserted into the passage 151 in such a manner that the valve body 30 is brought into contact with the plate spring 80.

Figure 5A:
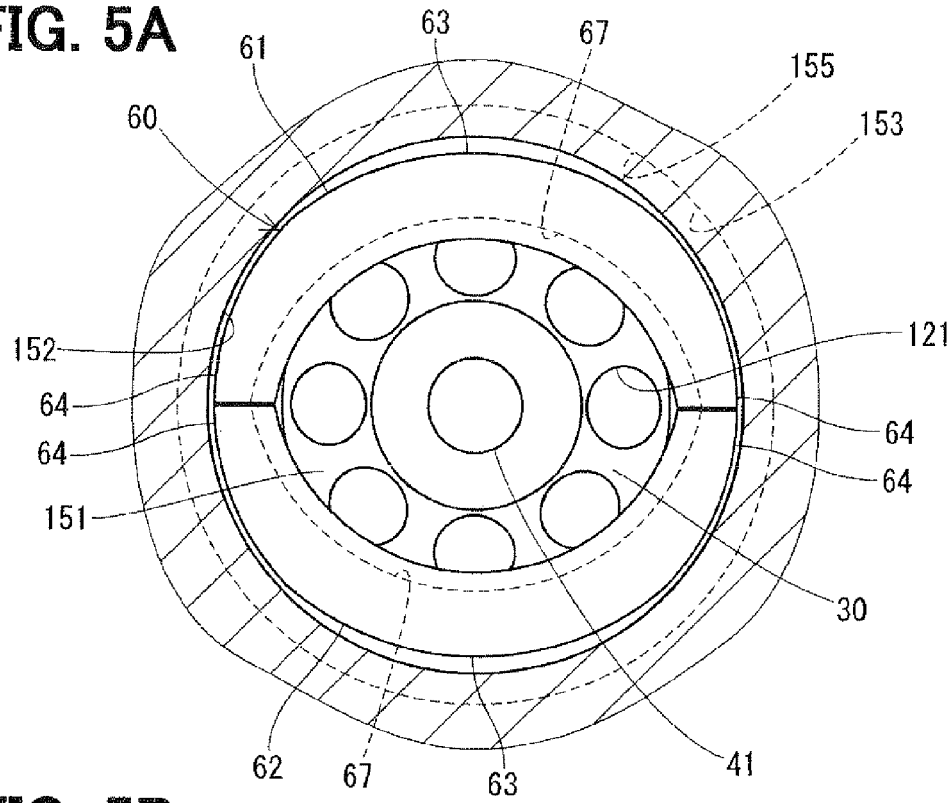
FIG. 5A is a cross sectional view showing a situation where the engaging member is in contact with the valve body.

(3) As shown in FIG. 5A, the valve body engaging member 60, which is in a condition that the first plate member 61 and the second plate member 62 are confronted to each other, is inserted into an inside of the passage wall surface 152 in such a manner as to be contact with the valve body 30.

(4) The valve body engaging member 60 is pressed toward the pressurizing chamber 113 against the plate spring 80 and is engaged with the engagement groove 153.

Figure 5B:
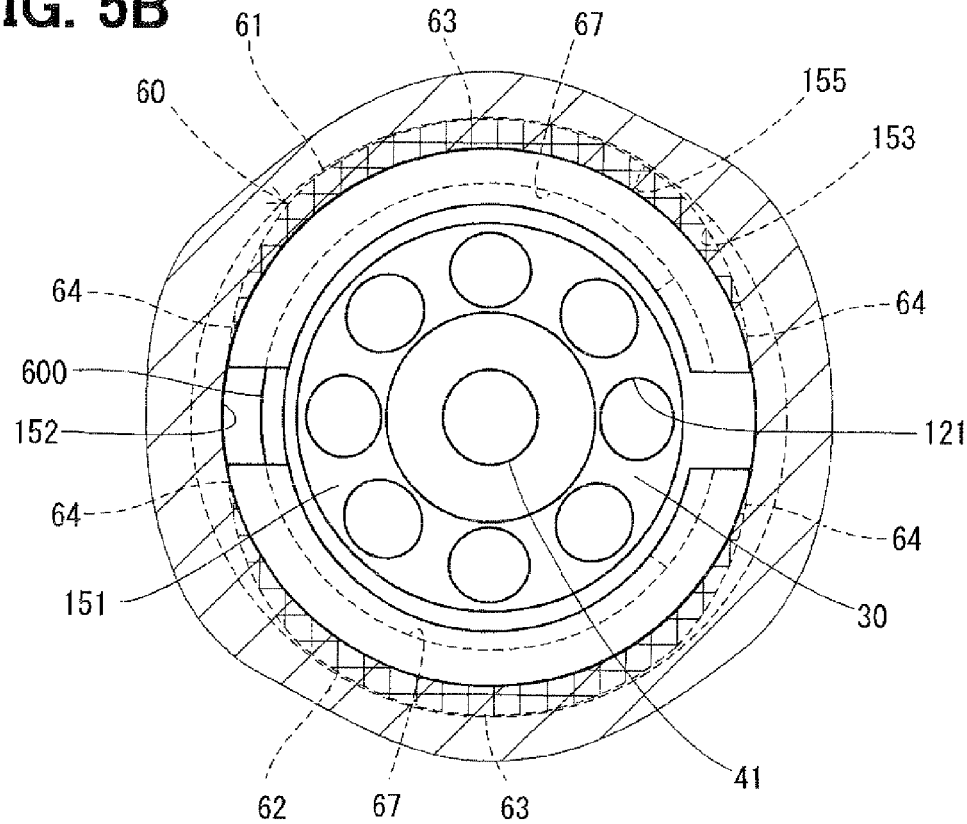
FIG. 5B is a cross sectional view showing a situation where the engaging member is inserted into an engagement groove and a C-ring is engaged with an inner peripheral of the engaging member.

(5) As shown in FIG. 5B, the C-ring 600 is disposed between the valve body 30 and the step surface 66.

The valve body 30 assembled to the housing body 11 is biased toward the valve body engaging member 60 by the plate spring 80, whereby the valve body is engaged with the valve body engaging member 60. The position of the valve body 30 is fixed in the passage 151.

As described above, the valve body engaging member 60 is configured in such a manner as to satisfy the above relationship (1). Since the radius "Rc" is larger than the radius "Rb", even if the radius "Ra" is larger than the radius "Rc", the valve body engaging member 60 can be easily and smoothly engaged with the engagement groove 153 with the first and the second plate member 61, 62 confronted to each other.

When the C-ring 600 is disposed inside of the valve body engaging member 60, the C-ring 600 exerts a resilient force in its radial outward direction. An outer periphery of the C-ring 600 is firmly in contact with the step side wall 67 and biases the first curved portion 63 of the plate members 61, 62 toward the outer wall 155 of the engagement groove 153. In the present embodiment, since the valve body engaging member 60 and the housing body 11 are configured to satisfy the relationship of "Ra"≦"Rd", a contacting area between the first curve portion 63 and the outer wall 155 can be made relatively large.

Figure 6A:
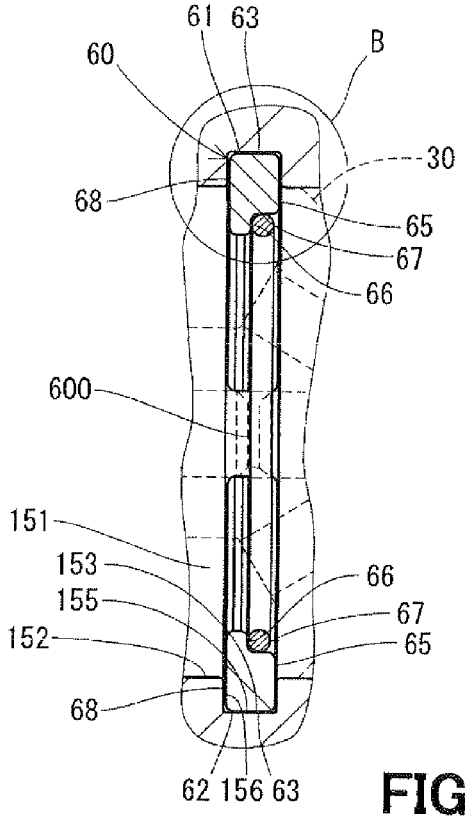
FIG. 6A is a fragmentary sectional view showing an engaging member and its vicinity of the high-pressure pump according to a first embodiment.
Figure 6B:
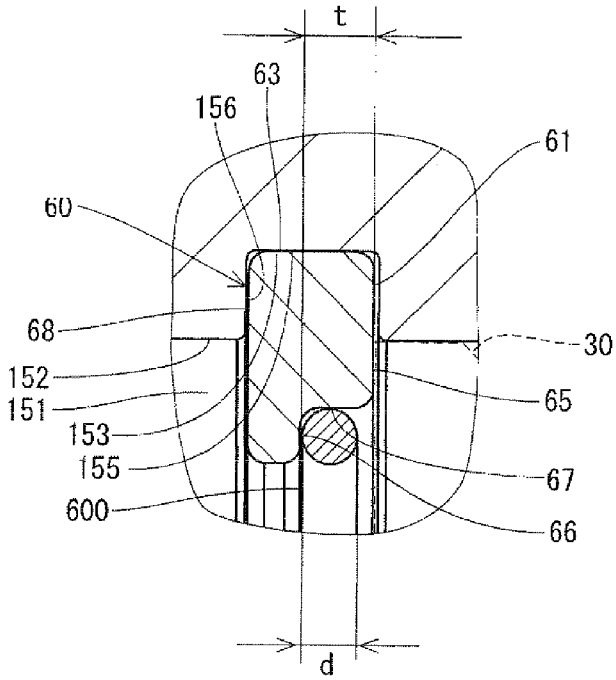
FIG. 6B is an enlarged view of a portion "B" in FIG. 6A.

Further, since the valve body engaging member 60 and the housing body 11 are configured to satisfy the relationship of "Rc"<"Ra"≦"Rd", as shown in FIGS. 5B and 6, a contacting area between a surface 68 of the valve body engaging member 60 and an annular surface 156 of the engagement groove 153 can be made relatively large. This contacting area is indicated by grid hatching in FIG. 5B. A circumferential length of the C-ring is about 80% of a circumferential length of the step side wall 67.

Figure 6C:
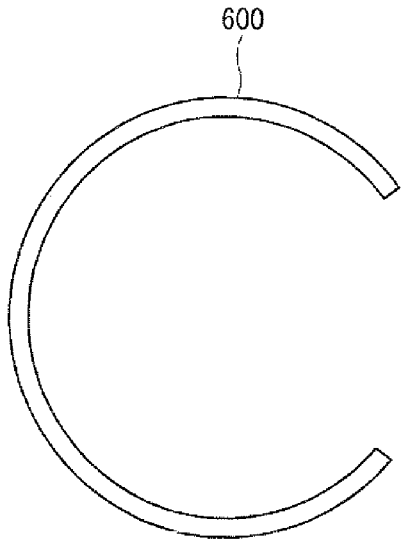
FIG. 6C is a front elevation view showing a C-ring.

As shown in FIGS. 5B, 6A, and 6C, the C-ring 600 is disposed between the step surface 66 and the valve body 30. The C-ring 600 has a circular cross section. In a case that a distance between the contacting surface 65 and the step surface 66 is denoted by "t" and a diameter of cross section of the C-ring 600 is denoted by "d", a relationship of "t">"d" is established. Thus, the C-ring 600 can be easily positioned between the valve body 30 and the step surface 66.

An operation of the high-pressure pump 10 will be described hereinafter.

[Suction Stroke]

When the plunger 13 slides down in FIG. 2, the coil 71 is deenergized. The suction valve 40 is biased toward the pressurizing chamber 113 by the spring 22. The suction valve 40 moves away from the suction valve seat 34. Further, when the plunger 13 slides down, the pressure in the pressurizing chamber 113 is decreased. Thus, the force which the suction valve 40 receives from the fuel in the concave portion 33 becomes larger than the force which the suction valve 40 receives from the fuel in the pressurizing chamber 113. The force biasing the suction valve 40 away from the suction valve seat 34 is further increased. The suction valve 40 moves until the suction valve 40 is brought in contact with the stopper 50. The fuel chamber 16 communicates with the pressurizing chamber 113 through the introducing passage 111, the passage 151, and the suction passage 112. The fuel in the fuel chamber 16 is suctioned into the pressurizing chamber 113 through the first passage 121, the second passage 122, the intermediate passage 124 and the third passage 123. The fuel in the intermediate passage 124 can flow into the volume chamber 54 through the communication passage 55. The pressure in the volume chamber 54 is equal to the pressure in the intermediate passage 124.

[Metering Stroke]

When the plunger 13 slides up toward the top dead center from the bottom dead center, the suction valve 40 receives the force from the fuel in the pressurizing chamber 113 so that the suction valve 40 sits on the suction valve seat 34. Meanwhile, when the coil 71 is deenergized, the needle 49 is biased to the suction valve 40 by the spring 22. Thus, the movement of the suction valve 40 toward the suction valve seat 34 is restricted by the needle 40.

In the metering stroke, while the coil 71 is deenergized, the suction valve 40 is positioned away from the suction valve seat 34. The fuel discharged from the pressurizing chamber 113 is returned into the fuel chamber 16 through the third passage 123, the intermediate passage 124, the second passage 122 and the first passage 121 in this series.

In the metering stroke, when the coil 71 is energized, a magnetic circuit is generated between the fixed core 72, the flange 75 and the movable core 73. Magnetic attraction force is generated between the fixed core 72 and the movable core 73. When this magnetic attraction force exceeds the biasing force of the spring 22, the movable core 73 and the needle 49 move toward the fixed core 72. The suction valve 40 moves away from the needle 49 and receives no force from the needle 49. Consequently, the suction valve 40 sits on the suction valve seat 34. That is, the suction valve 40 is closed.

In the present embodiment, the stopper 50 has the communication passage 55 which connects the intermediate passage 124 and the volume chamber 54. The pressure in the volume chamber 54 becomes equal to the pressure in the intermediate passage 124. That is, even if the pressure in the intermediate passages 124 becomes high, the pressure in the intermediate passages 124 does not exceed the pressure in the volume chamber 54. The suction valve 40 can easily move away from the stopper 50. Therefore, the suction valve 40 can be made to estrange easily from the cylinder portion 51 of the blade latch 50. Thereby, the suction valve 40 can be closed at a desired timing.

When the suction valve 40 sits on the suction valve seat 34, the second passage 122 is closed and the fuel flow flowing through the fuel passage 151 is interrupted. Thereby, the metering stroke in which the fuel is discharged from the pressurizing chamber 113 to the fuel chamber 16 is terminated. When the plunger 13 slides up, the fuel quantity returning to the fuel chamber 16 from the pressurizing chamber 113 is adjusted by closing the second passage 122. The quantity of fuel which will be pressurized in the pressurizing chamber 113 is determined.

[Pressurizing Stroke]

When the plunger 13 further slides up toward the top dead center with an interruption between the pressurizing chamber 113 and the fuel chamber 16, the fuel pressure in the pressurizing chamber 113 further increases. When the fuel pressure in the pressurizing chamber 113 exceeds a specified value, the suction valve 92 moves away from the discharge valve seat 95. Thereby, the discharge valve portion 90 is opened so that the pressurized fuel in the pressurizing chamber 113 is discharged from the high-pressure pump 10 through the discharge passage 114. The fuel discharged from the high-pressure pump 10 is accumulated in the delivery pipe (not shown) and is supplied to each fuel injector.

When the plunger 13 reaches the top dead center, the coil 71 is deenergized and the suction valve 40 is opened again. Further, when the plunger 13 starts sliding down, the pressure in the pressurizing chamber 113 is decreased. Thereby, the fuel is suctioned into the pressurizing chamber 113 from the fuel chamber 16.

It should be noted that the coil 71 may be deenergized when the suction valve 40 is closed so that the fuel pressure in the pressurizing chamber 113 reaches the specified value. When the fuel pressure in the pressurizing chamber 113 is increased, the force biasing the suction valve 40 to be closed becomes larger than the force biasing the suction valve 40 to be opened. Thus, even if the coil 71 is deenergized, the suction valve 40 maintains to be closed. By deenergizing the coil 71, the power consumption of the electromagnetic driving portion 70 can be reduced.

The above suction stroke, the metering stroke and the pressurizing stroke are conducted repeatedly, so that the high-pressure pump 10 pressurizes and discharges the fuel. The discharge quantity of fuel is adjusted by controlling the energization timing of the coil 71.

As described above, according to the present embodiment, the valve body engaging member 60 is comprised of two arc-shaped plate members 61 and 62, which form ring-shape when confronting to each other. The valve body engaging member 60 is inserted into the engagement groove 153 and is in contact with the valve body 30. Thereby, the position of the valve body 30 is fixed. The C-ring 600 is firmly in contact with the step side wall 67 and biases the plate members 61, 62 toward the outer wall 155 of the engagement groove 153. Thereby, it is restricted that the valve body engaging member 60 is disengaged from the engagement groove 153.

When assembling the valve body engaging member 60 to the housing body 11, the plate members 61, 62 are inserted into the engagement groove 153 and then the C-ring 600 is disposed inside of the valve body engaging member 60. Since the valve body engaging member 60 is comprised of two arc-shaped plate members 61, 62, it is unnecessary to elastically deform the valve body engaging member 60 when assembling the valve body engaging member 60 to the engagement groove 153. Thus, the plate members 61, 62 can be made of material having high hardness. Alternatively, the plate members 61, 62 can receive heat treating to improve the hardness thereof. The mechanical strength of the valve body engaging member 60 can be improved without deteriorating its assembling work.

Furthermore, according to the present embodiment, the valve body 30 can be positioned by the vale body engaging member 60 without utilizing an axial fastening force of a fastening member such as a bolt. Thus, it is unnecessary to configure the valve body engaging member 60 in such a manner as to receive the axial fastening force. The size of the high-pressure pump 10 can be made smaller.

In a case the first plate member 61 is confronted to the second plate member 62, the valve body engaging member 60 has the first curved portion 63 and the second curved portion 64 of which curvature is different from each other. The first curved portion 63 and the second curved portion 64 are alternately formed in circumferential direction at intervals of 90°. The valve body engaging member 60 and the housing body 11 are configured to satisfy the relationship of "Rb"<"Rc"<"Ra"≦"Rd".

Since "Rc" is larger than "Rb", even if "Ra" is larger than "Rc", the valve body engaging member 60 can be easily and smoothly engaged with the engagement groove 153 with the first and the second plate member 61, 62 confronted to each other. Further, since "Rd" is greater than or equal to "Ra", the contacting area between the outer periphery of the member 60 and the outer wall 155 can be made relatively large. Thereby, a stress applied to the valve body engaging member 60 can be reduced, and the position of the member 60 in the engagement groove 153 becomes stable. Furthermore, since the relationship of "Rc"<"Ra"≦"Rd" is established, the contacting area between the surface 68 of the valve body engaging member 60 and the flat surface 156 of the engaging groove 153 can be made relatively large. Thereby, even when a large pressure is applied to the contacting surface 65, the pressure applied to the surface 68 can be reduced.

The first and second plate members 61, 62 have a step surface 66 at the contacting surface 65 which is in contact with the valve body 30. The C-ring 600 is disposed between the step surface 66 and the valve body 30. In a case that a distance between the contacting surface 65 and the step surface 66 is denoted by "t" and a diameter of cross section of the C-ring 600 is denoted by "d", a relationship of "t">"d" is established. Thus, the C-ring 600 can be easily positioned between the valve body 30 and the step surface 66. Further, a clearance is formed between the C-ring 600 and the valve body 30 and/or between the C-ring 600 and the step surface 66. Even if the contacting surface 65 receives a large pressure, the C-ring 600 is never crushed between the valve body 30 and the valve body engaging member 60.

The hardness of the plate members 61, 62 is greater than that of the C-ring 600. Thus, the durability of the plate members 61, 62 can be improved and an elastic force of the C-ring 600 can be suitably established.

Second Embodiment

Figure 7:
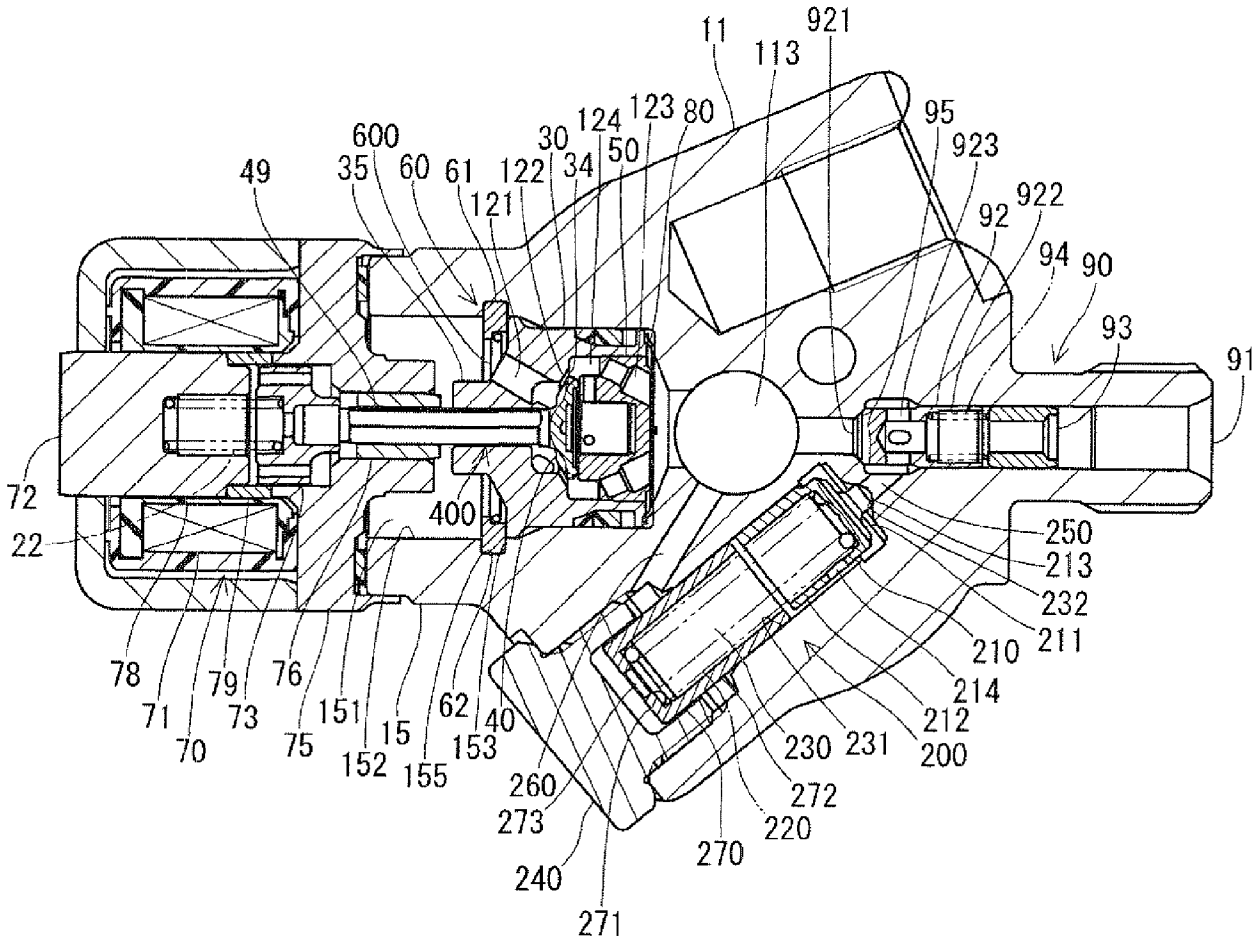
FIG. 7 is a cross-sectional view showing a high-pressure pump according to a second embodiment of the invention.

FIG. 7 shows a high-pressure pump according to a second embodiment. FIG. 7 is a cross-sectional view corresponding to a cross-sectional view taken along a line X-X in FIG. 2.

In the second embodiment, the suction valve 40 and the needle 49 are formed from a single piece. When the moving core 73 is magnetically attracted to the fixed core 72, the suction valve 40 and the needle 49 move toward the fixed core 72 to be closed. Thus, in the second embodiment, a biasing member biasing the suction valve 40 in its close direction is not necessary.

The housing body 11 is provided with a relief-valve portion 200. The relief-valve portion 200 controls the fuel pressure in the pressurizing chamber 113 when the fuel pressure in the delivery pipe becomes extremely large. The relief-valve portion 200 includes a relief valve 210 and a spring 220 which biases the relief valve 210.

The housing 11 defines a passage 230 therein. A cylindrical passage wall 231 defines the passage 230. One end of the passage 230 is opened on an outer surface of the housing body 11. This opening is fluidly closed by a lid member 240. The other end of the passage 230 communicates with a small-diameter passage 250 of which inner diameter is smaller than that of the passage 230. A relief-valve seat 232 is defined between the passage 230 and the small-diameter passage 250.

The small-diameter passage 250 communicates with a discharge passage 114. A passage 260 is connected to the passage 230 at a vicinity of the lid member 240. The other end of the passage 260 is connected to the pressurizing chamber 113. Thus, the passage 230 communicates with the fuel outlet 91 through the small-diameter passage 250 and communicates with the pressurizing chamber 113 through the passage 260.

The relief valve 210 is slidably arranged in the passage 230. The relief valve 210 is made of martensite stainless steel of which hardness is improved by heat treating. The relief valve 210 is comprised of a bottom portion 211 and cylindrical portion 212. The bottom portion 211 has a seat portion 213. The seat portion 213 can be in contact with the relief-valve seat 242. When the relief valve 210 sits on the relief-valve seat 232, the passage 230 is closed. When the relief valve 210 moves away from the relief-valve seat 232, the passage 230 is opened. Further, the cylindrical portion 212 has an aperture 214.

A cylindrical stopper 270 is press-inserted into the passage 230. The stopper 270 is made of austenite stainless steel. The hardness of the stopper 270 is lower than that of the relief valve 210. The stopper 270 is comprised of a bottom portion 271 and a cylindrical portion 272. The bottom portion 271 has an aperture 273.

A spring 220 is disposed between the bottom portion 271 of the stopper 270 and the bottom portion 211 of the relief valve 210. One end of the spring 220 is engaged with the bottom portion 271 and the other end is engaged with the bottom portion 211. The relief valve 210 is biased toward the relief-valve seat 232 by the spring 220.

When the fuel pressure in the discharge passage 114 exceeds a specified value, the relief valve 210 moves toward the stopper 270, whereby the relief valve 210 is opened.

When the relief-vale body 210 is opened, the fuel in the discharge passage 114 is returned to the pressurizing chamber 113. Thereby, it is prevented that the fuel in a delivery pipe (not shown) becomes excessively large.

The valve body engaging member 60, the C-ring 600, the valve body engaging member 60 and the engagement groove 153 have the same configuration as those in the first embodiment. The second embodiment has the substantially the same advantages as the first embodiment.

Third Embodiment

Figure 8:
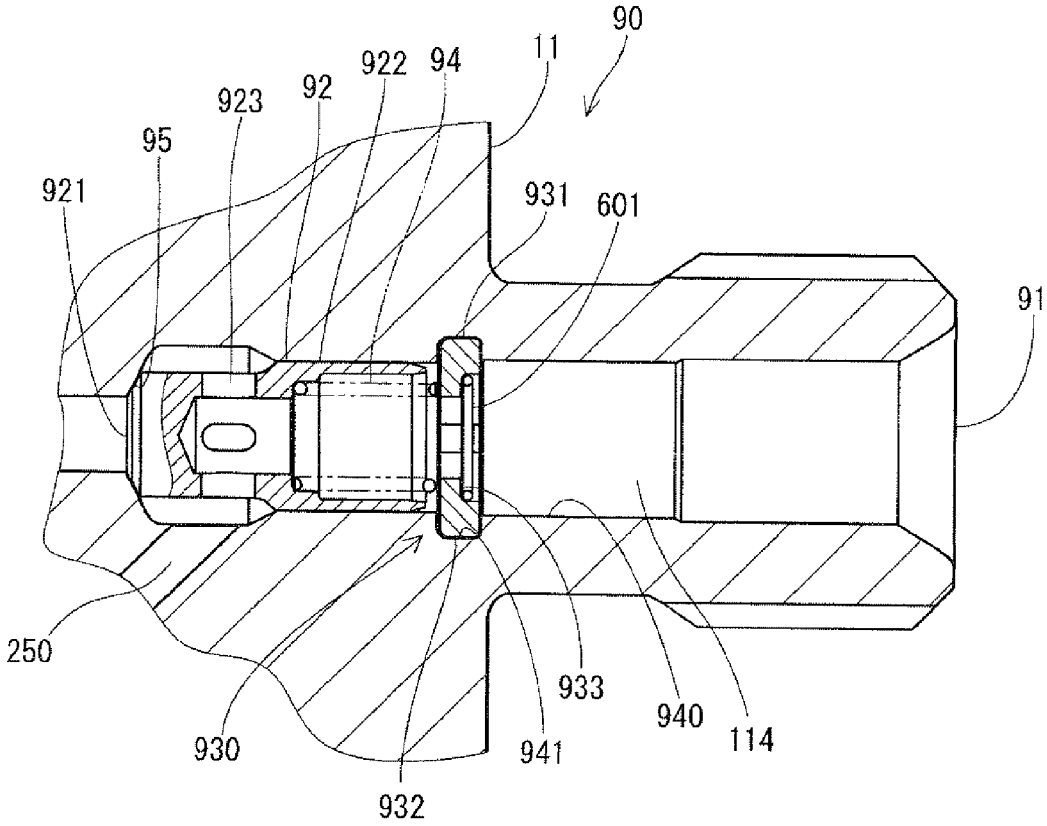
FIG. 8 is a fragmentary cross-sectional view showing a high-pressure pump according to a third embodiment of the invention.

FIG. 8 shows a part of a high-pressure pump according to a third embodiment. FIG. 8 is a cross-sectional view showing a discharge valve portion 90. The third embodiment is different from the second embodiment only in a configuration of the discharge valve portion 90.

The discharge valve portion 90 is comprised of a discharge valve 92, a spring 94 and a discharge-valve engaging member 930. The housing body 11 has the discharge passage 114 which is defined by a passage wall surface 940.

Further, the housing body 11 has an annular engagement groove 941 on the passage wall surface 940. The discharge-valve engaging member 930 is inserted to the engagement groove 941. The discharge valve 92 is biased toward the discharge valve seat 95 by a spring 94 which is engaged with the discharge-valve engaging member 930. The discharge valve 92 can reciprocate in the discharge passage 114 between the discharge valve seat 95 and the discharge-valve engaging member 930. The discharge valve 92 moves away from the discharge valve seat 95 until the discharge valve 92 is confronted to the discharge-valve engaging member 930. In the third embodiment, it is unnecessary to provide a regulation member 93, because the discharge-valve engaging member 930 functions as a stopper of the discharge valve 92. The discharge passage 114 corresponds to a part of a fuel passage of the present invention. The discharge valve 92 corresponds to "an engaged member", and The discharge-valve engaging member 930 corresponds to "an engaging member" of the present invention.

A C-ring 601 is provided inside of the discharge-valve engaging member 930. The C-ring 601 is made of austenite stainless steel. The C-ring 601 has resilience in its radial outward direction. The C-ring 601 biases the discharge-valve engaging member 930 radially outwardly so that it is prevented that the discharge-valve engaging member 930 is disengaged from the engagement groove 153.

The discharge-valve engaging member 930 is comprised of two arc-shaped plate members 931, 932. These plate members 931, 932 are made of martensite stainless steel, and have substantially the same hardness of the discharge valve 92. The hardness of the plate members 931, 932 is greater than that of the C-ring 601. The first plate member 931 and the second plate member 62 are arc-shaped. In a case that the first plate member 931 is confronted to the second plate member 932, these plate members 931, 932 form an annular shape. The discharge-valve engaging member 930 has the first curved portion and the second curved portion of which curvature is different from each other. The first curved portion and the second curved portion are alternately formed in circumferential direction at intervals of 90°.

A relationship between a curvature radius of the first curved portion, a curvature radius of the second curved portion, an inner diameter of the passage wall surface 940, and an outer diameter of the engagement groove 941 is the same as the relationship between "Ra", "Rb", "Rc" and "Rd" in the first embodiment. Thus, the third embodiment has substantially the same advantages as the first embodiment.

The first and second plate members 931, 932 have a step surface 933. The C-ring 601 is arranged at the step surface 933.

In the above first and the second embodiment, the regulation member 93 is provided as a stopper of the discharge valve 92. However, the hardness of the regulation member 93 is lower than that of the discharge valve 92. If the discharge valve 92 is brought in contact with the regulation member 93 repeatedly, it is likely that the regulation member 93 may be abraded. Meanwhile, in the present embodiment, since the hardness of the discharge valve 92 is substantially equal to that of the discharge-valve engaging member 930, an abrasion of the discharge-valve engaging member 930 is restricted.

Fourth Embodiment

Figure 9:
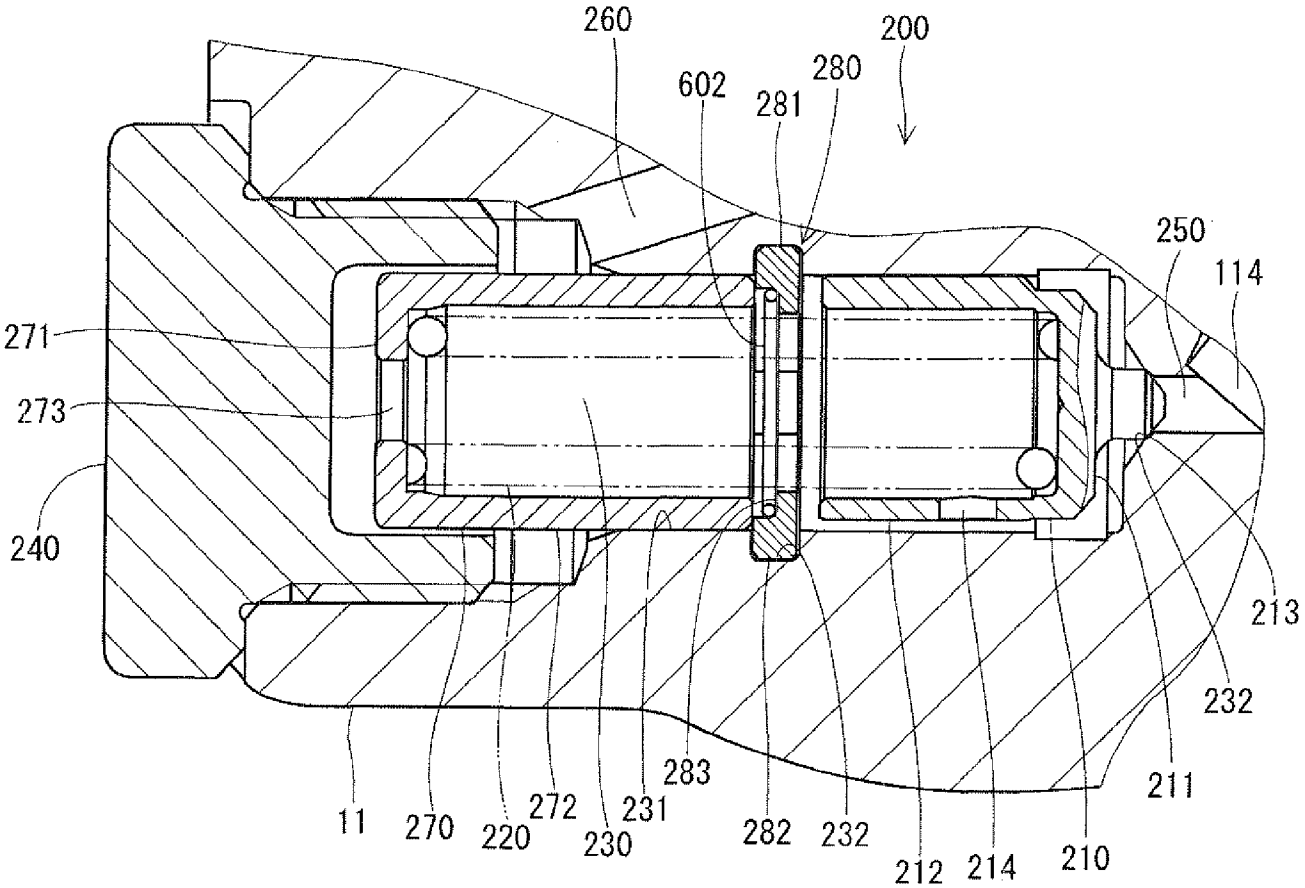
FIG. 9 is a fragmentary cross-sectional view showing a high-pressure pump according to a fourth embodiment of the invention.

FIG. 9 shows a part of a high-pressure pump according to a fourth embodiment. FIG. 9 is a cross-sectional view showing a relief valve portion 200. The fourth embodiment is different from the second embodiment only in a configuration of the relief valve portion 200.

The relief valve portion 200 is comprised of a relief valve 210, a spring 220 and a relief-valve engaging member 280. The housing body 11 has a passage 230 which is defined by a passage wall surface 231. Further, the housing body 11 has an annular engagement groove 232 on the passage wall surface 231. The relief-valve engaging member 280 is inserted into the engagement groove 232 between the regulation member 270 and the relief valve 210. The regulation member 270 is in contact with the relief-valve engaging member 280.

The relief valve 210 is biased toward a relief valve seat 232 by the spring 220 which is engaged with the regulation member 270. The relief valve 210 can reciprocate in the passage 230 between the relief valve seat 232 and the relief-valve engaging member 280. The relief valve 210 moves away from the relief valve seat 232 until the relief valve 210 is confronted to the relief-valve engaging member 280. The relief-valve engaging member 280 functions as a stopper of the relief valve 210. The passage 230 corresponds to a part of a fuel passage of the present invention. The relief valve 210 corresponds to "an engaged member", and the relief-valve engaging member 280 corresponds to "an engaging member" of the present invention.

A C-ring 602 is provided inside of the relief-valve engaging member 280. The C-ring 602 is made of austenite stainless steel. The C-ring 602 has resilience in its radial outward direction. The C-ring 602 biases the relief-valve engaging member 280 radially outwardly so that it is prevented that the relief-valve engaging member 280 is disengaged from the engagement groove 232.

The relief-valve engaging member 280 is comprised of two arc-shaped plate members 281, 282. These plate members 281, 282 are made of martensite stainless steel, and have substantially the same hardness of the relief valve 210.

The hardness of the plate members 281, 282 is greater than that of the C-ring 602. The first plate member 281 and the second plate member 282 are arc-shaped. In a case that the first plate member 281 is confronted to the second plate member 282, these plate members 281, 282 form an annular shape. The relief-valve engaging member 280 has the first curved portion and the second curved portion of which curvature is different from each other. The first curved portion and the second curved portion are alternately formed in circumferential direction at intervals of 90°.

A relationship between a curvature radius of the first curved portion, a curvature radius of the second curved portion, an inner diameter of the passage wall surface 231, and an outer diameter of the engagement groove 232 is the same as the relationship between "Ra", "Rb", "Rc" and "Rd" in the first embodiment. Thus, the fourth embodiment has substantially the same advantages as the first embodiment.

The first and second plate members 281, 282 have a step surface 283. The C-ring 602 is arranged at the step surface 283. Therefore, it is restricted that the C-ring 602 is disengaged from the relief-valve engaging member 280.

In the present embodiment, since the hardness of the relief valve 210 is substantially equal to that of the relief-valve engaging member 280, an abrasion of the relief-valve engaging member 280 is restricted.

Fifth Embodiment

Figure 10:
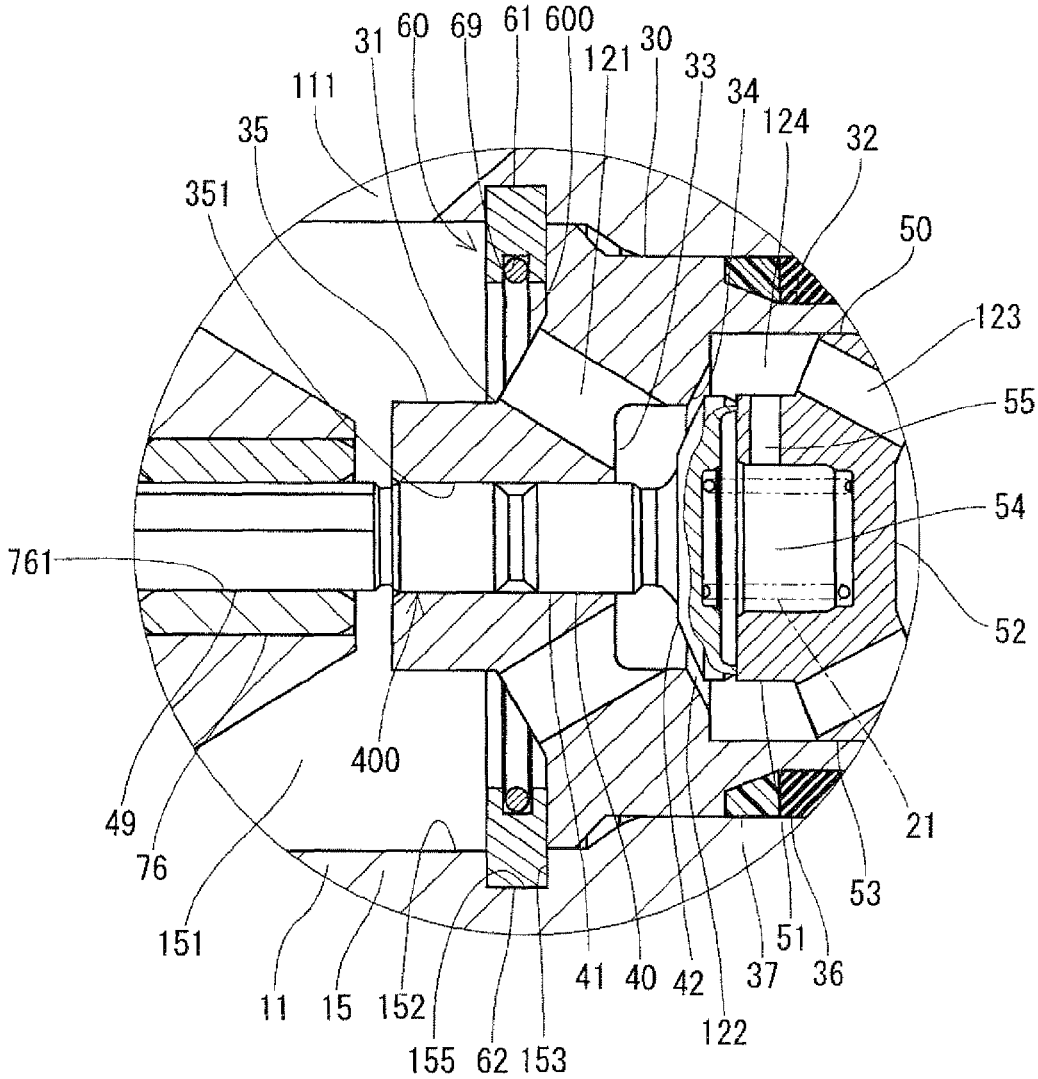
FIG. 10 is a fragmentary cross-sectional view showing a high-pressure pump according to a fifth embodiment of the invention.

FIG. 10 shows a part of a high-pressure pump according to a fifth embodiment. FIG. 10 is a cross-sectional view showing a valve body engaging member 60. The fifth embodiment is different from the first embodiment only in a configuration of the valve body engaging member 60.

The valve body engaging member 60 has a circular groove 69 on its inner peripheral surface. A C-ring 600 is inserted into the circular groove 69. Thereby, it is restricted that the C-ring 600 is disengaged from the circular groove 69.

The circular groove 69 is arranged at center position in an axial direction of the valve body engaging member 60. Thus, the C-ring 600 uniformly biases the first and the second plate members 61, 62 toward the outer wall 155. The position of the plate members 61, 62 in the engagement groove 153 becomes stable.

Other Embodiment

The above first to fourth embodiments can be combined suitably. The configuration of the valve body engaging member 60 of the fifth embodiment can be applied to the second to fourth embodiments.

The engaging member can be comprised of three or more arc-shape plate members.

The engaging member can have a third curved portion between the first curved portion and the second curved portion. The third curved portion has a curvature radius which is intermediate between the curvature radius of the first curved portion and the second curved portion. The curvature radius is smoothly changed from the first curved portion to the second curved portion.

The C-ring may have a rectangular shape of cross section. A contacting area of the C-ring can be made large. The position of the engaging member in the engagement groove becomes more stable.

In the above embodiments, the valve is a normally-open valve. A normally-close valve can be used.

The engaging member can be utilized to various devices other than a high-pressure pump.

The present invention is not limited to the embodiments mentioned above, and can be applied to various embodiments.

What is claimed is:

1. A high-pressure pump comprising:

a plunger performing a reciprocating movement;

a housing having a pressurizing chamber where a fuel is pressurized by the plunger; a fuel passage communicating with the pressurizing chamber; and an annular engagement groove formed on a passage wall which defines the fuel passage;

an engaged member disposed inside of the passage wall;

an engaging member comprised of a plurality of arc-shaped plate members, the engaging member being inserted into the annular engagement groove in such a manner as to be engaged with the engaged member; and a resilient member disposed inside of the engaging member in such a manner as to resiliently bias the arc-shaped plate members radially outwardly, wherein the engaging member has a first curved portion and a second curved portion each of which curvature is different, the first curved portion and the second curved portion are alternately formed in circumferential direction at intervals of 90°, and a curvature radius "Ra" of the first curved portion, a curvature radius "Rb" of the second curved portion, an inner diameter "Rc" of the engagement groove and an outer diameter "Rd" of the engagement groove have a relationship of "Rb"<"Rc"<"Ra"≦"Rd".

2. A high-pressure pump according to claim 1, wherein the engaging member has an annular step surface on an inner peripheral surface thereof, the annular step surface is apart from a side-surface of the engaging member by a specified distance, the resilient member is a C-ring disposed adjacent to the step surface, and the specified distance is greater than a cross-sectional width of the resilient member.

3. A high-pressure pump according to claim 1, wherein the engaging member has a circular groove on an inner peripheral surface thereof, and the resilient member is a C-ring inserted into the circular groove.

4. A high-pressure pump according to claim 1, wherein the arc-shaped plate members and the resilient member are made of metallic material, and a hardness of the arc-shaped plate members is higher than that of the resilient member.

5. A high-pressure pump according to claim 1, wherein the engaged member is a valve body which is provided inside of the passage wall and has a suction valve seat, and the engaging member is a valve body engaging member which is engaged with the valve body, the high-pressure pump further comprising;

a valve member having a suction valve which is seated on or unseated from the suction valve seat to close or open the fuel passage and a needle provided to the suction valve; and an electromagnetic driving portion having a coil portion which magnetically attracts the needle in a valve close direction or a valve open direction.

6. A high-pressure pump according to claim 5, wherein the suction valve and the needle are formed from a single integrate piece, and the needle is biased by a biasing member in such a manner that the suction valve is opened.

7. A high-pressure pump according to claim 5, wherein the suction valve and the needle are formed from separate pieces, the high-pressure pump further comprising:

a needle biasing member biasing the needle in such a manner as to open the suction valve; and a suction-valve biasing member biasing the suction valve in such a manner as to close the suction valve.

8. A high-pressure pump according to claim 1, wherein the engaged member is a discharge valve provided in the fuel passage in such a manner as to close/open the fuel passage, and the engaging member is a discharge-valve engaging member which can be engaged with the discharge valve in order to restrict a movement of the discharge valve in a valve opening direction, the high-pressure pump further comprising:

a discharge-valve biasing member biasing the discharge valve in such a manner as to close the discharge valve.

9. A high-pressure pump according to claim 1, wherein the engaged member is a relief valve provided in the fuel passage in such a manner as to connect the fuel passage with the pressurizing chamber, the engaging member is a relief-valve engaging member which can be engaged with the relief valve in order to restrict a movement of the relief valve in a valve opening direction, the high-pressure pump further comprising:

a relief-valve biasing member biasing the relief valve in such a manner as to close the relief valve.

* * * * *